US006318321B1

(12) United States Patent
Kensok et al.

(10) Patent No.: US 6,318,321 B1
(45) Date of Patent: Nov. 20, 2001

(54) METHOD OF MODIFYING MOTORCYCLE ENGINE CAM DRIVE

(75) Inventors: Steven A. Kensok, Viroquo; Scott A. Sjoval, Westby; Dan Kinsey, Lafarge; Tim Culver, Muscoda, all of WI (US)

(73) Assignee: S&S Cycle, Inc., Viola, WI (US)

( * ) Notice: Subject to any disclaimer, the term of this patent is extended or adjusted under 35 U.S.C. 154(b) by 0 days.

(21) Appl. No.: 09/547,536

(22) Filed: Apr. 12, 2000

(51) Int. Cl.[7] ..... F01L 1/02
(52) U.S. Cl. ..... 123/90.31; 123/90.17
(58) Field of Search ..... 123/90.15, 90.17, 123/90.31, 90.6; 74/568 R

(56) References Cited

U.S. PATENT DOCUMENTS

| | | | | |
|---|---|---|---|---|
| 4,617,882 | * | 10/1986 | Matsumoto | 123/90.31 |
| 4,831,975 | * | 5/1989 | Yoshimoto et al. | 123/90.31 |
| 4,836,156 | * | 6/1989 | Inagaki et al. | 123/90.31 |
| 5,181,432 | * | 1/1993 | Allen | 74/395 |

OTHER PUBLICATIONS

American Spares & Repairs, "Trease Race Engineering", Brochure (Date Unknown).
Harley–Davidson Motor Company, "1997 Dyna Models Parts Catalog Official Factory Manual", pp. 18–19 (1996).
Harley–Davidson Motor Company, "2000 XLH Models Parts Catalog Official Factory Manual", pp. 16–17 (1999).
Yamaha Motor Corporation, "XV16AL/XV16ALC XV16ATL/XV16ATLC Service Manual", First Edition, pp. 5–29 through 5–30, (Oct. 1998).

* cited by examiner

*Primary Examiner*—Weilun Lo
(74) *Attorney, Agent, or Firm*—Merchant & Gould P.C.

(57) ABSTRACT

A method of modifying the cam drive arrangement of a motorcycle engine. The method includes providing an existing cam gear arrangement having a crankshaft sprocket connected to a primary camshaft sprocket with a chain, removing the chain, replacing each of the sprockets with a crankshaft gear and primary camshaft gear respectively, and engaging teeth of the gears so the crankshaft gear drives the primary camshaft gear directly. A specific method for modifying a TWIN CAM 88 engine, made by Harley-Davidson, according to this method, is also described.

10 Claims, 2 Drawing Sheets

METHOD OF MODIFYING MOTORCYCLE ENGINE CAM DRIVE

FIELD OF THE INVENTION

This invention relates generally to cam drive arrangements for motorcycle engines, and more particularly to a method of modifying the cam drive arrangement of a motorcycle engine.

BACKGROUND OF THE INVENTION

Both gear driven and chain driven cam drive arrangements are known in the motorcycle engine art. These cam drive arrangements involve one or more cams, each of which lifts one or more sets of intake and exhaust valves through corresponding lobes positioned on the camshaft. In the known gear drive arrangements, a crankshaft gear directly drives either a sole camshaft gear, or a primary camshaft gear which in turn drives two or more secondary camshaft gears. Known chain drive arrangements are employed in either a push rod configuration or in an "overhead cam" configuration. In the overhead cam chain drive configuration, one or more crankshaft sprockets are connected to respective overhead cam sprockets with one or more long chains. In the push rod chain drive configuration most pertinent here, typically a crankshaft sprocket is connected to a primary camshaft sprocket with a chain; a second chain then connects typically two secondary camshaft sprockets, one of which is on the same shaft as the primary camshaft sprocket.

In 1998 (for model year 1999), Harley-Davidson introduced a new big twin engine called the "TWIN CAM 88." That engine employs a chain drive arrangement generally as depicted in FIG. 1. There are a number of problems associated with the TWIN CAM 88 cam drive design. The design employs chain tensioners pressing against the outside of each chain with the intent that the chain be kept from going slack. However, over time the tensioners wear down, and the chains stretch, both of which contribute to chain slack that results in inaccurate cam timing. Material from the tensioners and chains wearing also contributes to engine debris. Also, the high force (on the order of 50 lbs.) the tensioners apply to the chains is transmitted to the camshafts, which increases camshaft bearing wear. Other shortcomings have become apparent when modifying the engine for improved performance. For example, when high performance valve springs are installed, horsepower is lost due to inadequate performance of the chain tensioners. When cams with larger, high lift cam lobes are installed, as depicted in FIG. 1, the front and rear cam lobes will interfere with one another due to the closeness of the two camshafts and their direction of rotation. The TWIN CAM 88 chain drive arrangement also requires substantial maintenance because the chains and chain tensioners wear. Disassembly and assembly of the arrangement is also time consuming because of, among other things, the various parts that must be correctly assembled together, as for example accurately timing the crankshaft and camshafts. Chain drive arrangements are also inherently dangerous because a chain break can result in catastrophic engine damage or even rider injury.

It can be seen that a method is needed for modifying a chain drive cam arrangement of a motorcycle engine that reduces or eliminates these shortcomings.

SUMMARY OF THE INVENTION

In one aspect of the method of the present invention, a method of modifying the cam drive arrangement of a motorcycle engine comprises providing an existing, cam drive arrangement having a crankshaft sprocket, a primary camshaft sprocket, and first and second secondary camshaft sprockets, with the crankshaft and primary camshaft sprockets connected to each other with a first chain, and the secondary sprockets connected to each other with a second chain. The chains are removed, and each of the sprockets is replaced respectively with a crankshaft gear, a primary camshaft gear, and first and second secondary camshaft gears. The teeth of the crankshaft gear and primary gear are engaged together, and the teeth of the two secondary gears are engaged together, so that the crankshaft gear drives the primary gear directly, and the first secondary gear drives the second directly.

In another aspect of the method of the present invention, a method of modifying the cam drive arrangement of a motorcycle engine comprises providing an existing cam gear arrangement having a crankshaft sprocket connected to a primary camshaft sprocket with a chain, removing the chain, replacing each of the sprockets with a crankshaft gear and a primary camshaft gear respectively, and engaging teeth of the gears together so that the crankshaft gear drives the primary camshaft gear directly.

These and other advantages and features of novelty which characterize the invention are pointed out with particularity in the claims annexed hereto. However, for a better understanding of the invention and its advantages, reference should be made to the drawings which form a further part hereof, and to the accompanying descriptive matter in which there is illustrated and described a preferred embodiment of the invention.

DETAILED DESCRIPTION OF THE PREFERRED EMBODIMENT

Figure 1:
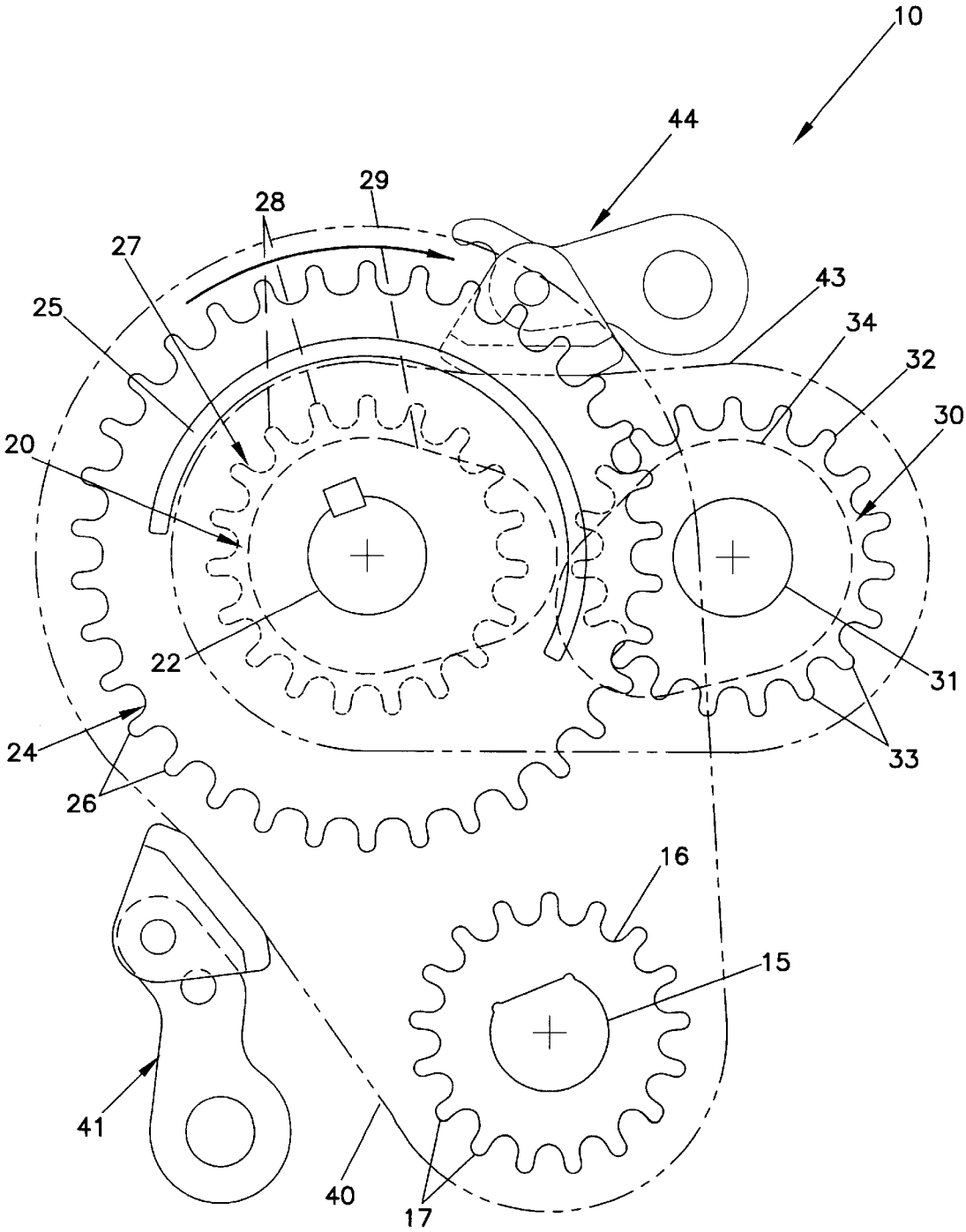
FIG. 1 is a plan view of a prior art chain drive arrangement.

Referring to FIG. 1, chain drive arrangement 10 for the TWIN CAM 88 engine, made by Harley-Davidson, is generally shown. Chain drive arrangement 10 includes crankshaft sprocket 16 and front 30 and rear 20 cams. Crankshaft 15 turns crankshaft sprocket 16, which in turn drives primary camshaft sprocket 24 through first chain 40 connecting teeth 17, 26. Primary camshaft sprocket 24 and first secondary camshaft sprocket 27 are both affixed to shaft 22. Therefore, rotation of shaft 22 by first chain 40 (clockwise as indicated by arrow) causes equal rotation of first secondary camshaft sprocket 27. First secondary sprocket 27 then drives second secondary camshaft sprocket 32 through second chain 43 connecting teeth 28, 33 with both sprockets 27, 32 again rotating clockwise.

Secondary sprockets 27, 32 are positioned in the same plane in board (into the page) relative to primary camshaft sprocket 24. A cam support plate (not shown) separates primary 24 and secondary 27, 32 camshaft sprockets and supports shafts 22, 31 on bearings. Further in board are exhaust lobes 29, 34 on shafts 22, 31, and yet further inboard are intake lobes (not shown) on shafts 22, 31. The intake lobes are oriented approximately 100 degrees counterclockwise from exhaust lobes 29, 34. The intake and exhaust lobes lift tappets which, through push rods and rocker arms, open the intake and exhaust valves respectively of the two cylinders of the engine.

Chain drive arrangement 10 also includes chain tensioners 41, 44 corresponding to first 40 and second 43 chains. Tensioners 41, 44 include a plastic pad or guide shoe that bears against chains with the force of a preset spring load, as shown. In this way, tensioners 41, 44 deform chain inward, thereby tensioning chains 40, 43. Timing ring 25 on primary camshaft sprocket 24 will be discussed below.

Figure 2:
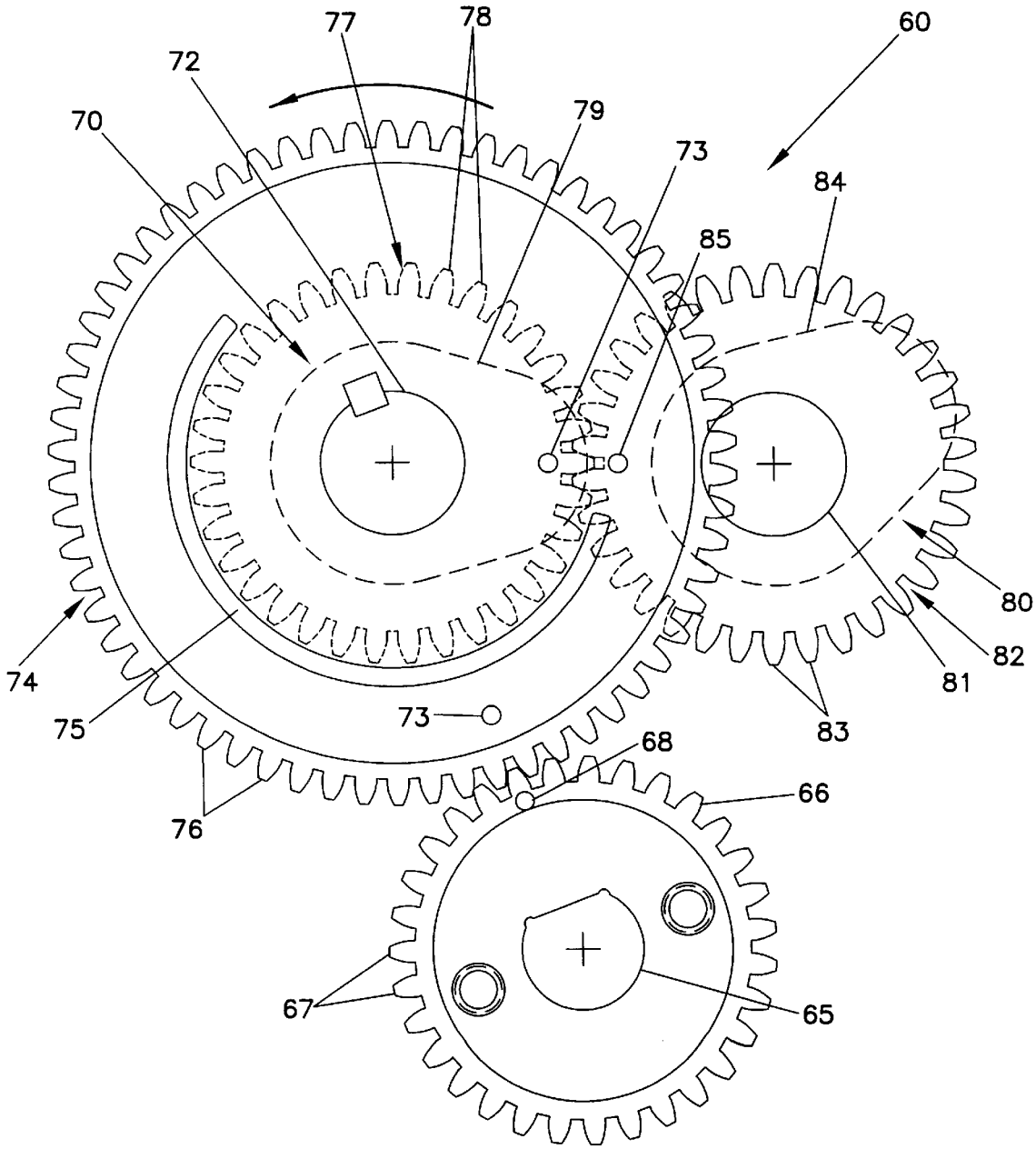
FIG. 2 is a plan view of a gear drive arrangement according to the method of the present invention.

Referring to FIG. 2, gear drive arrangement 60, created by modifying chain drive arrangement 10 according to the preferred method discussed below, includes crankshaft gear 66 and front 80 and rear 70 cams. Crankshaft 65 turns crankshaft gear 66, which in turn drives primary camshaft gear 74 through engaging teeth 67, 76. With primary 74 and first secondary 77 gears fixed to shaft 72, first secondary camshaft gear 77 in turn drives second secondary camshaft gear 82 through engaging teeth 78, 83. Lobes 79, 84 on shafts 72, 81 respectively operate the tappets, push rods, rocker arms, and valves as described above with respect to chain drive arrangement 10. The relative inboard/outboard position of the various parts is also the same as the corresponding parts (gears corresponding to sprockets) of chain drive arrangement 10, as described above.

A significant difference between gear drive 60 and chain drive 10 arrangements is that rear cam 70 rotates in a direction opposite to rear cam 20, as shown by the arrows in FIGS. 1 and 2. If larger cam lobes are installed in chain drive arrangement 10, as depicted in FIG. 1, lobes 29, 34 of the two cams will interfere. This necessarily limits the extent to which engine horsepower can be increased through higher lifting lobes. In gear drive arrangement 60, by contrast, due to the opposite rotation of rear cam 70, lobes 79, 84 are rotationally offset so that they cannot interfere, thereby permitting larger lobes and better performance. Also as a result of the opposite rotation of rear cam 70, both the intake and exhaust lobes of rear cam 70 must be specially machined to shapes that are a mirror image of the respective lobes of front cam 80. Also, the rear cam intake lobe (not shown) is oriented approximately 100 degrees clockwise from exhaust lobe 79, and the front cam intake lobe (also not shown) is oriented approximately 100 degrees counterclockwise from exhaust lobe 84. Also, timing ring 75 on primary camshaft gear 74 is oriented approximately 180 degrees opposite, and preferably 172 degrees counterclockwise, of timing ring 25 on primary camshaft sprocket 24.

Further details of the preferred gear drive arrangement 10 are as follows. Crankshaft gear 66 has 31 teeth and is approximately 2.0 inches in diameter (from tip to tip of teeth). Cams 70, 80 (which include a shaft and intake and exhaust lobes) are each machined as a single part. Primary 74 and secondary 77, 82 gears are fixedly attached to the respective cam parts 70, 80. Primary camshaft gear 74 has 62 teeth and is 3.7 inches in diameter, and secondary camshaft gears 77, 82 have 34 teeth and are approximately 2.1 inches in diameter. Teeth 67, 76, 78, 83 are sized and configured to reduce noise and to minimize the diameter of primary gear 74. In order to accommodate the larger primary camshaft gear 74, a small amount of material had to be removed from the aluminum cover of the TWIN CAM 88 engine that encloses the arrangement.

In the preferred method (some aspects of which are already described above), the chain drive arrangement 10 of FIG. 1 is provided. That arrangement is modified try removing chains 40, 43 and chain tensioners 41, 44, and replacing crankshaft sprocket 16, primary sprocket 24 and front 30 and rear 20 cams (in their entirety) with crankshaft gear 66, primary gear 74 and front 80 and rear 70 cams, respectively. The existing cam lobes are also preferably replaced with larger lobes 79, 84 for higher horsepower. Corresponding teeth are engaged (67 with 76, and 78 with 83) so that gears 74, 82 are driven directly and without chains. The techniques for removing and replacing the various parts are well known in the art. Timing marks 68, 73, 85 are provided on the gears to properly orient cams 70, 80 relative to crankshaft 65 during installation.

It will be understood that the method of the present invention could involve various cam gear arrangements other than those described above. For example, instead of two cams in the existing, arrangement, there could be only one cam or more than two (for example four) cams. Various chain drive arrangements and various gear drive arrangements can also be envisioned; for example, the primary camshaft sprocket or gear can be on a shaft separate from the secondary camshaft sprockets or gears. Also, while the preferred method involves replacing the entire cam, including lobes, only a portion of the cam could be replaced within the principles of the present invention, as for example simply replacing the sprocket with a gear.

It will further be understood that, even though numerous specific characteristics and advantages of the present invention have been set forth in the foregoing description, together with details of the structure and function of the invention, this disclosure is illustrative only, and changes may be made in detail, especially in matters of shape, size, arrangement of parts, and order of steps, within the principles of the invention to the full extent indicated by the broad general meanings of the terms in which the appended claims are expressed.

We claim:

1. A method of modifying a cam drive arrangement of a motorcycle engine, including an existing cam drive arrangement having a crankshaft sprocket, a primary camshaft sprocket, and first and second secondary camshaft sprockets, with the crankshaft and primary camshaft sprockets connected to each other with a first chain, and a secondary sprockets connected to each other with a second chain; the method comprising the steps of:

removing the chains;

replacing each of the sprockets with a crankshaft gear, a primary camshaft gear, and first and second secondary camshaft gears, respectively; and engaging teeth of the crankshaft gear and primary gear together, and of the secondary gears together, so that the crankshaft gear drives the primary gear directly, the primary gear and first secondary gear being coaxially mounted and the first secondary gear drives the second directly.

2. A method according to claim 1, further comprising removing chain tensioners from each of the chains in the existing cam gear arrangement.

3. A method according to claim 1, wherein replacing the primary camshaft sprocket includes providing a primary camshaft gear having a timing trigger ring oriented approximately 180° opposite its orientation on the primary camshaft sprocket.

4. A method according to claim 1, further comprising reconfiguring the shape of cam lobes corresponding to the primary camshaft gear so as to account for that gear rotating in a direction opposite to that of the primary camshaft sprocket.

5. A method according to claim 1, further comprising replacing cam lobes in the existing cam drive arrangement with larger cam lobes that produce higher valve lift and longer valve opening duration.

6. A method according to claim 1, wherein the crankshaft gear has approximately 31 teeth.

7. A method according to claim 1, wherein the crankshaft gear has a diameter of approximately 2.0 inches and the primary camshaft gear a diameter of approximately 3.7 inches.

8. A method according to claim 1, wherein the first and second secondary camshaft gears have approximately 34 teeth and a diameter of approximately 2.1 inches.

9. A method according to claim 1, wherein the existing cam drive arrangement has exactly two secondary camshaft sprockets, with the first secondary camshaft sprocket sharing a common shaft with the primary camshaft sprocket.

10. A method according to claim 1, wherein engaging teeth of the gears together includes orienting the gears relative to one another for proper cam timing using timing marks on each gear.

* * * * *